US007651060B2

(12) United States Patent
Roth et al.

(10) Patent No.: US 7,651,060 B2
(45) Date of Patent: Jan. 26, 2010

(54) BUCKET HOLD-DOWN WITH STRAP AND FOOT LEVERS

(76) Inventors: Russell W. Roth, 15950 Ringgold Northern Road, Ashville, OH (US) 43103; Paul R. Stamper, 750 Gilmore Dr., Reynoldsburg, OH (US) 43069

( * ) Notice: Subject to any disclaimer, the term of this patent is extended or adjusted under 35 U.S.C. 154(b) by 0 days.

(21) Appl. No.: 12/048,975

(22) Filed: Mar. 14, 2008

(65) Prior Publication Data

US 2008/0224010 A1 Sep. 18, 2008

Related U.S. Application Data

(60) Provisional application No. 60/918,134, filed on Mar. 16, 2007.

(51) Int. Cl.
*A47G 23/02* (2006.01)

(52) U.S. Cl. ..... 248/146; 248/500; 248/346.01; 248/346.03; 366/349

(58) Field of Classification Search ..... 248/528, 248/519, 529, 346.01, 346.03, 151, 146, 248/188, 500; 220/737, 561, 565; 366/500
See application file for complete search history.

(56) References Cited

U.S. PATENT DOCUMENTS 1,808,763 A * 6/1931 Burdett ..... 220/737
2,788,189 A * 4/1957 Groya ..... 248/152
2,853,261 A * 9/1958 Loeb ..... 248/151
3,208,314 A * 9/1965 Locke ..... 81/436
3,239,176 A * 3/1966 Johnson ..... 248/166
4,088,294 A * 5/1978 Aliment et al. ..... 248/519
4,898,352 A * 2/1990 Hoffman ..... 248/96
5,078,350 A * 1/1992 Zorichak ..... 248/148
5,839,602 A * 11/1998 Mowry ..... 220/737
6,370,817 B1 * 4/2002 Brooks et al. ..... 47/43
6,776,379 B2 * 8/2004 Sherer et al. ..... 248/150
D523,922 S * 6/2006 Brubacher et al. ..... D23/206
7,494,097 B2 * 2/2009 Lidie et al. ..... 248/126
7,540,462 B1 * 6/2009 Beden ..... 248/346.03
2003/0016586 A1 * 1/2003 Williams ..... 366/349
2004/0021043 A1 * 2/2004 Zagorsky ..... 248/146
2005/0045780 A1 * 3/2005 Forshee et al. ..... 248/146
2006/0124808 A1 * 6/2006 Hibbler ..... 248/146
2006/0202093 A1 * 9/2006 Grosse ..... 248/146
2007/0056979 A1 * 3/2007 Dunson ..... 220/737

* cited by examiner

*Primary Examiner*—Amy J Sterling
(74) *Attorney, Agent, or Firm*—Bernhard P. Molldrem, Jr.

(57) ABSTRACT

A hold-down for a common pail used in mixing paints, dry-wall compound, or other applications has a pair of swing-down, spring-loaded step-pads secured to the base of the pail. There can be a strap for this purpose, with an adjustable draw latch.

7 Claims, 6 Drawing Sheets

BUCKET HOLD-DOWN WITH STRAP AND FOOT LEVERS

This application claims priority of Provisional Application 60/918,134, filed Mar. 16, 2007.

BACKGROUND OF THE INVENTION

This invention relates to a device to improve the utility and function of five-gallon polyethylene buckets (and other similar containers), making them more stable during mixing and other preparation procedures.

In many building trades, contractors and workmen use the common five-gallon plastic bucket for preparing mixtures, such as mortar, tile-setting grout, drywall compound, drywall finishes, paint, and other coatings. The normal practice is to try and trap the bucket between the feet or between the worker's knees while using a drill equipped with a mixing attachment to blend the product. This does not provide a very secure grip on the bucket, and it often occurs that the bucket moves, tips over, or sometimes spins out of control. When this happens, it can produce costly spills, with waste of material, require time-consuming clean-up, and can possibly result in injury to the workman.

OBJECTS AND SUMMARY OF THE INVENTION

Accordingly, it is an object of the present invention to improve the stability of the bucket when it is being used to prepare a product, i.e., by mixing components in the bucket.

It is another object to provide a bucket hold-down system that is simple, convenient to use, clamps on to a range of sizes of bucket, and stays close to the bucket when not in use.

In accordance with one aspect of the present invention, a bucket stabilizing hold-down device has a strap that clamps around the lower end of the bucket, and there are two spring-loaded swing-down members, i.e., foot-pads or step-pads. A draw latch on the strap allows the device to accommodate variations in bucket diameters. The draw latch may have a threaded adjustment for this purpose. The two spring-loaded step pads or feet swing down easily, and the worker can step onto these to secure the bucket in place with his weight. This eliminates the possibility of the bucket spinning out of control, thus avoiding costly spills and property damage, and also avoiding possible strain injuries of the worker(s). The device may be made of steel, aluminum, another metal or an alloy, or may be fabricated of a plastic resin, i.e., the device may be adapted to be molded. In that case it may incorporate a reinforcement, e.g., glass fibers or metal wires. Also, the device may be of a design that is adapted to be molded so that the base portions of the foot-pads or step-pads are integral to the bucket.

The above and many other objects, features, and advantages of this invention will be more fully appreciated from the ensuing description of a preferred embodiment, which is to be read in conjunction with the accompanying Drawing.

BRIEF DESCRIPTION OF THE DRAWING

The FIG. 1 is a perspective view a bucket with a bucket hold-down incorporating the beverage holder assembly according to an embodiment of the present invention.

DETAILED DESCRIPTION OF THE PREFERRED EMBODIMENT

Figure 5:
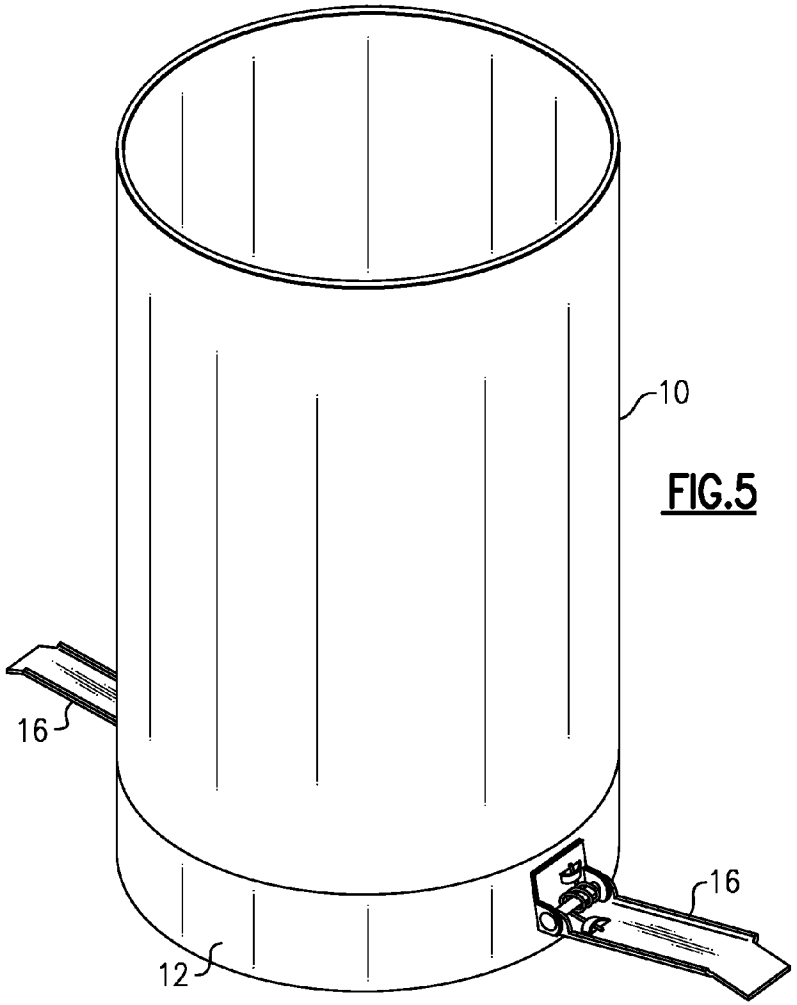
FIG. 5 is a perspective thereof.
Figure 1:
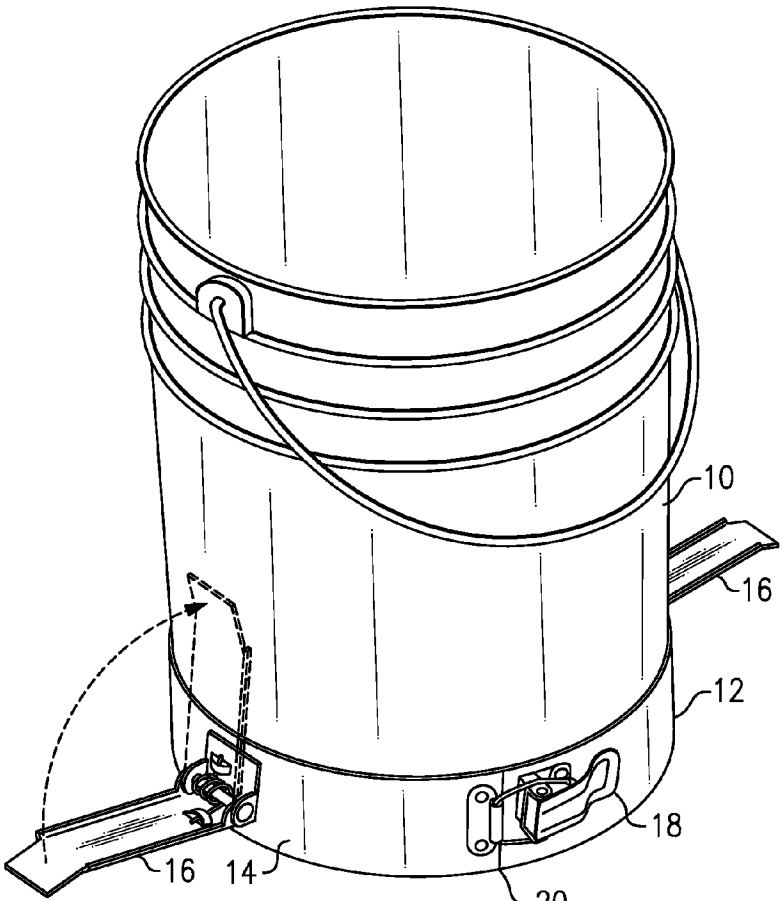
Figure 2:
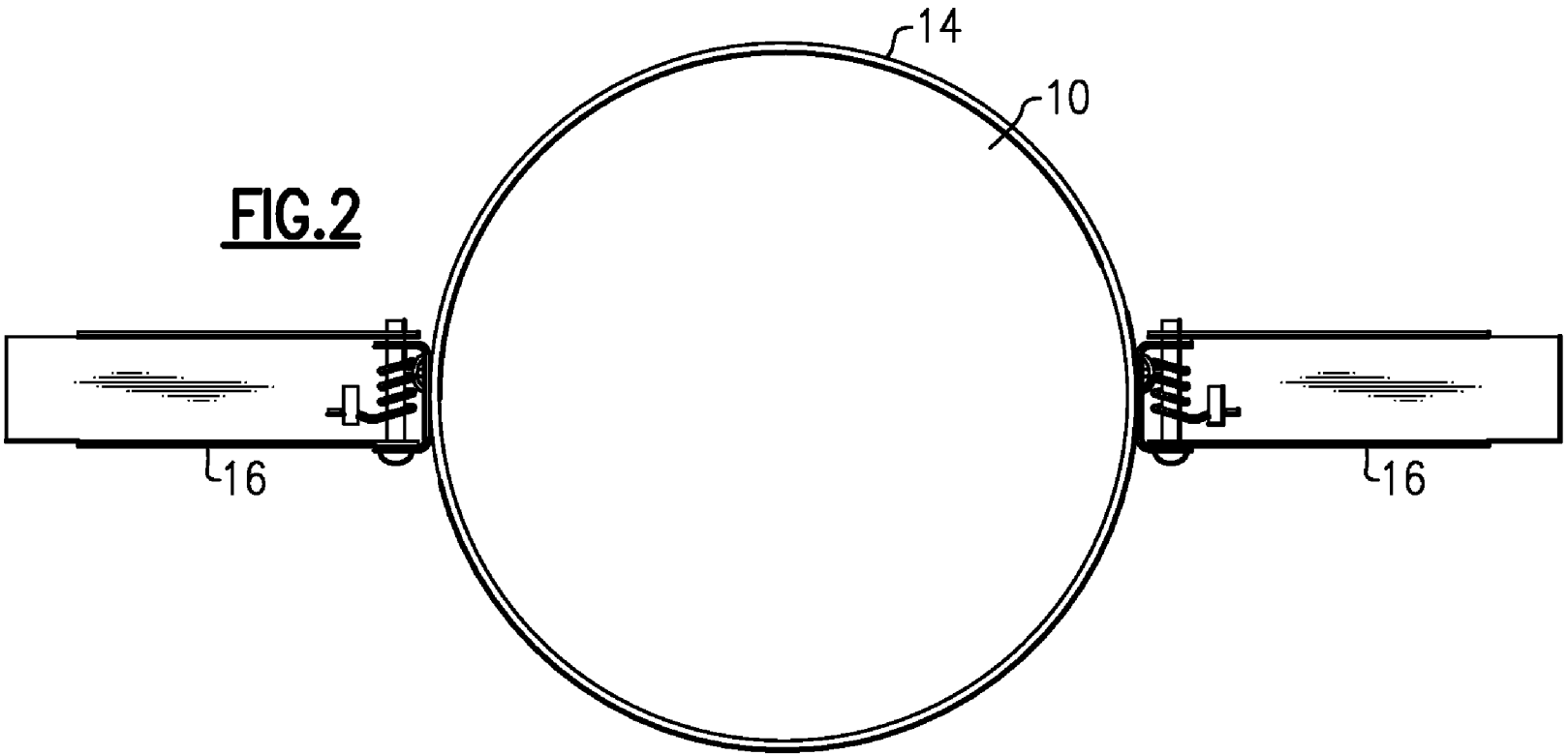
FIG. 2 is a top plan view of the bucket and hold-down.
Figure 3:
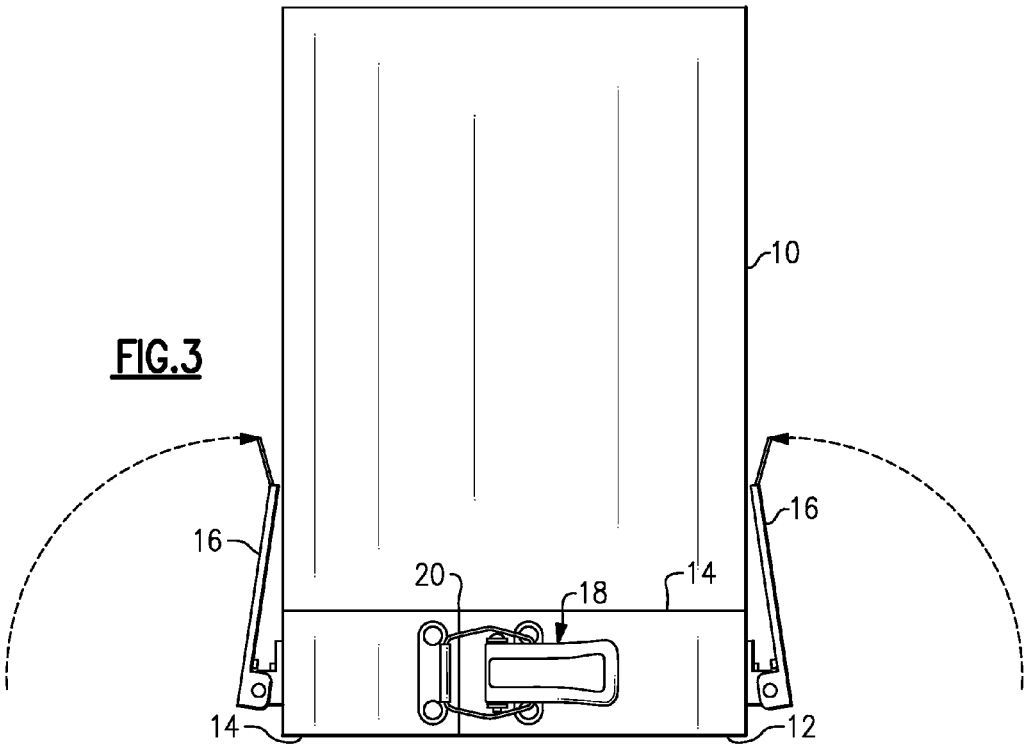
FIG. 3 is a front elevation thereof, showing the step-pads at the sides, and showing a draw latch at the front.
Figure 4:
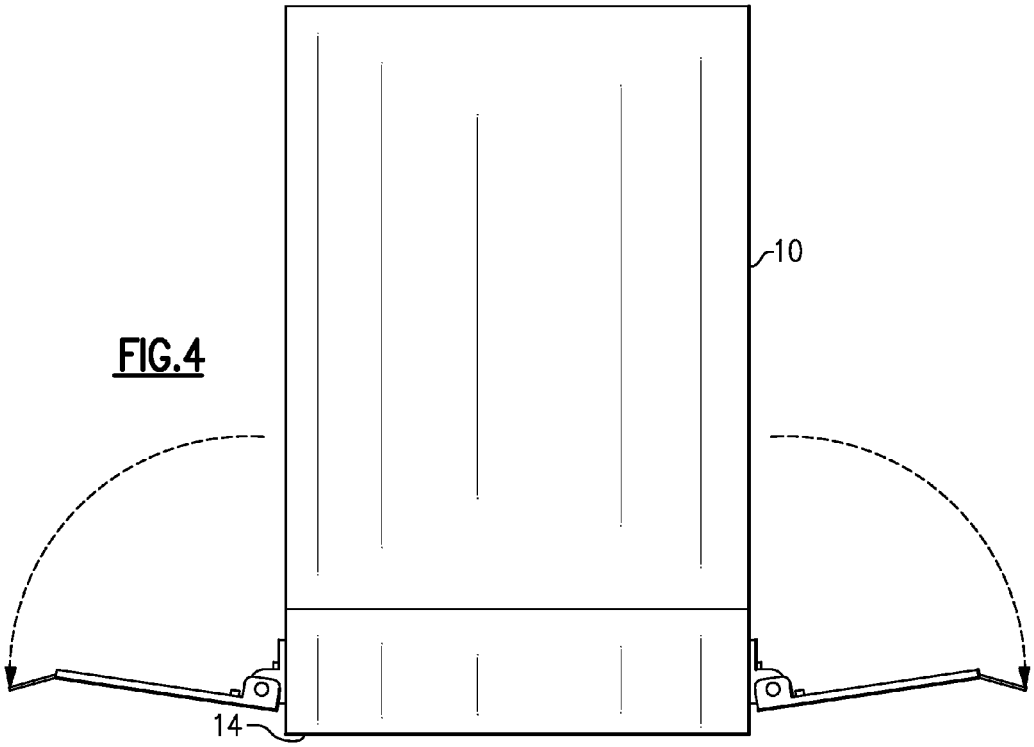
FIG. 4 is a rear elevation thereof.
Figure 8:
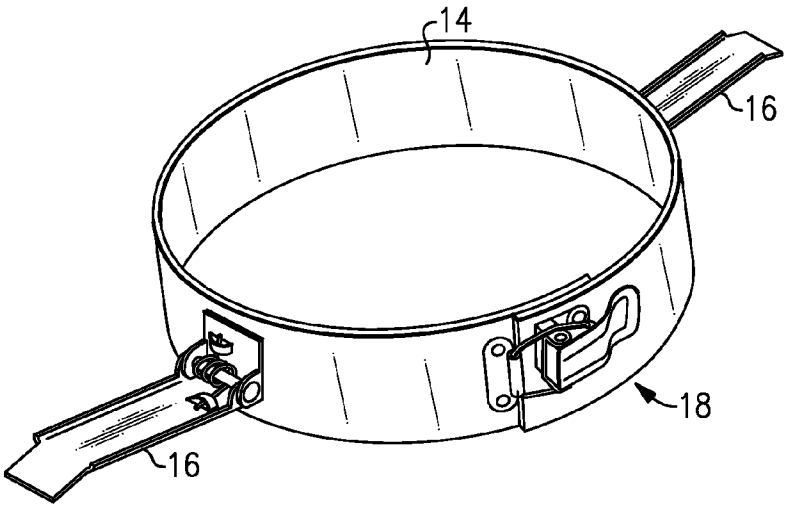
FIG. 8 is another perspective, also showing the draw latch.
Figure 6:
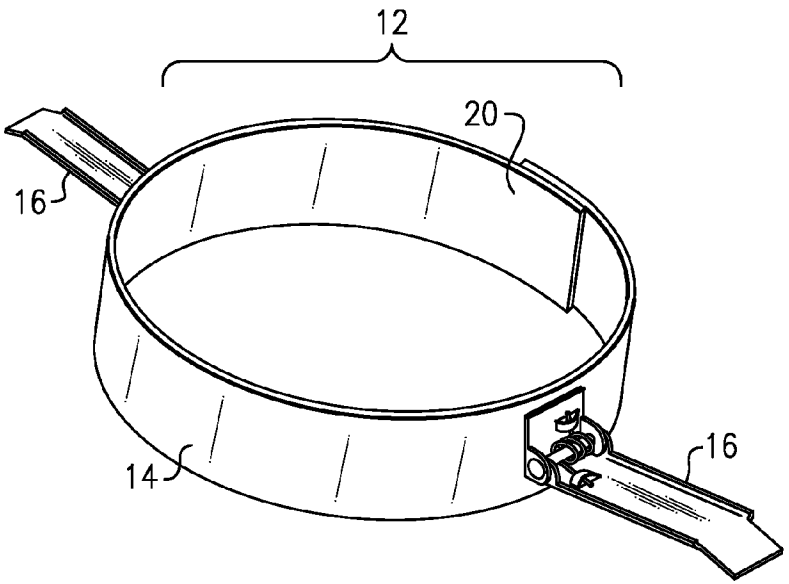
FIG. 6 is a perspective view of the bucket hold-down showing the strap and step-pads.
Figure 7:
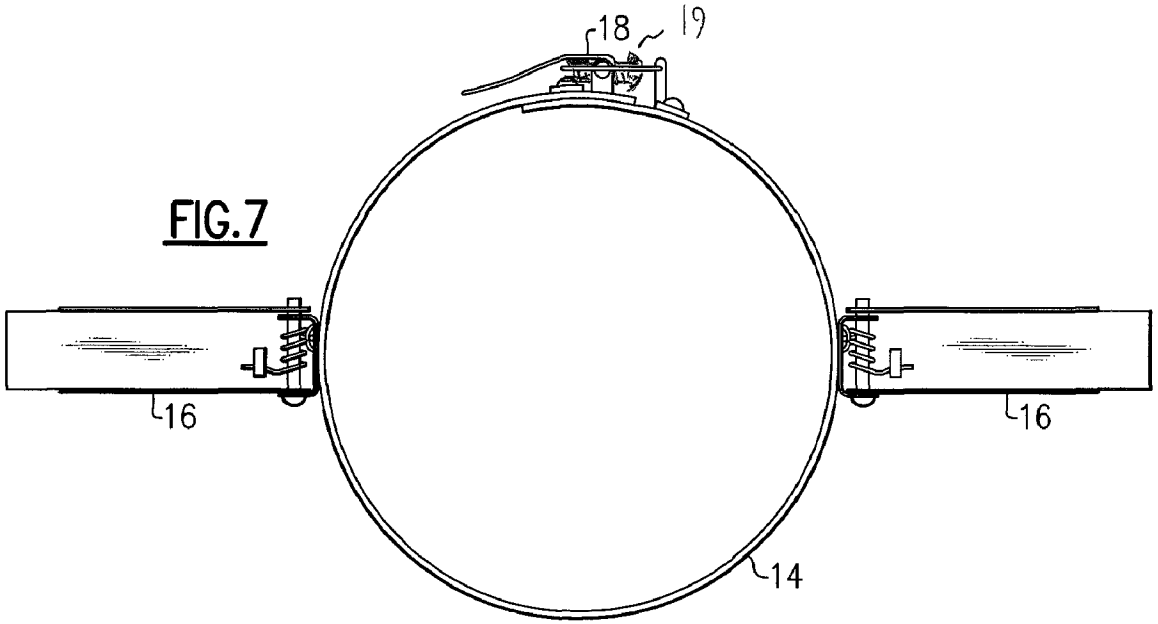
FIG. 7 is a top plan view thereof.
Figure 9:
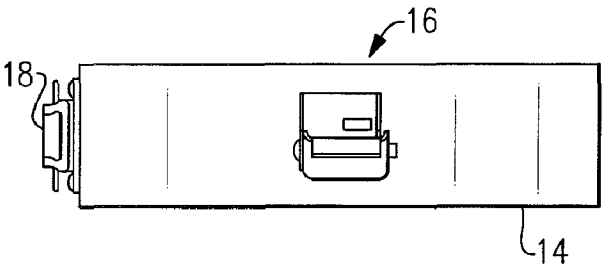
FIG. 9 is a side elevation thereof.
Figure 10:
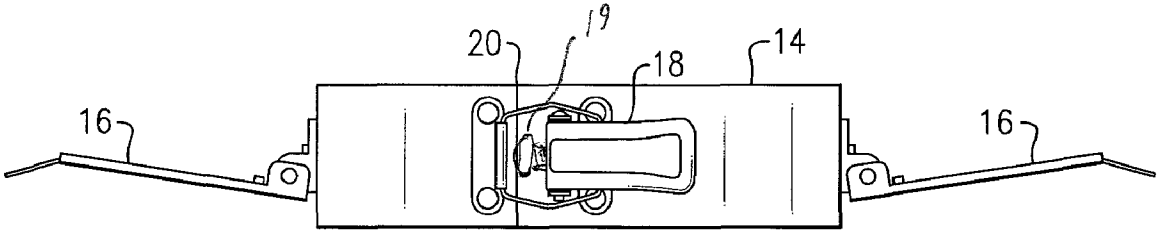
FIG. 10 is a front elevation thereof.
Figure 11:
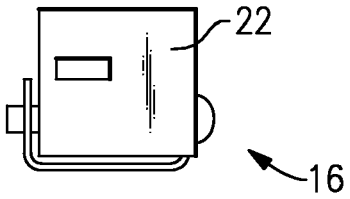
FIG. 11 is an back end view of one of the foot pads or step pads.
Figure 12:
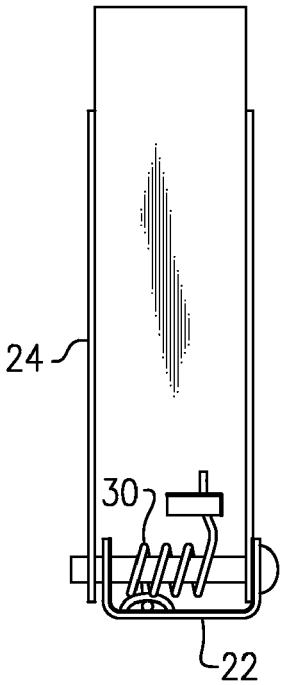
FIG. 12 is a top view thereof.
Figure 13:
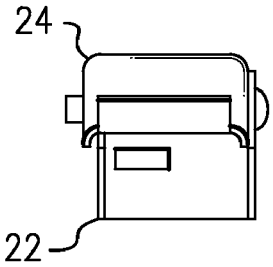
FIG. 13 is a front end view thereof.
Figure 15:
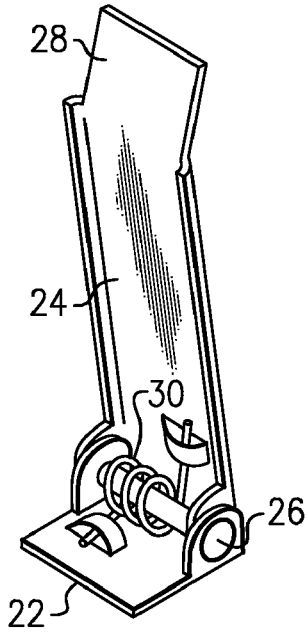
FIG. 15 is a perspective view thereof.

With reference now to the Drawing, and initially to FIG. 1, a five-gallon pail or bucket 10 is shown with the bucket hold-down 12, of one embodiment of the invention, attached to its base. Here, the bucket 10 can be of the type of polyethylene or similar pail that is often used in painting, drywall installation, or other fields, for compounding and mixing a solution or mixture, e.g., drywall compound, paint, cement, or the like. However, the bucket hold-down 12 of this invention could also be used with a metal bucket or drum, or a bucket made of other materials. The hold-down is shown in more detail in FIGS. 2 through 10. The hold-down 12 in this embodiment is formed of a metal strap 14 that encircles the base of the pail 10, with a pair of swing-down step pads or foot pads 16, 16 situated on opposite sides of the pail. A draw style latch 18 is placed at a location 20 where the two ends of the strap 14 meet. There is about a one-and-one-half-inch overlap at this location 20. The draw latch includes a threaded latch bolt 19 with about a one-inch adjustment, and the draw latch has a stroke of about one-and-one-eighth inches to close. The latch bolt 19 provides the means for screw adjustment of the strap circumference to adapt to the pail size. This provides a snug fit onto a variety of common styles and sizes of pails. Here, there are two foot pads 16 disposed diametrically opposite one another, but in other embodiments these foot pads could be separated by more or less arc distance.

Figure 14:
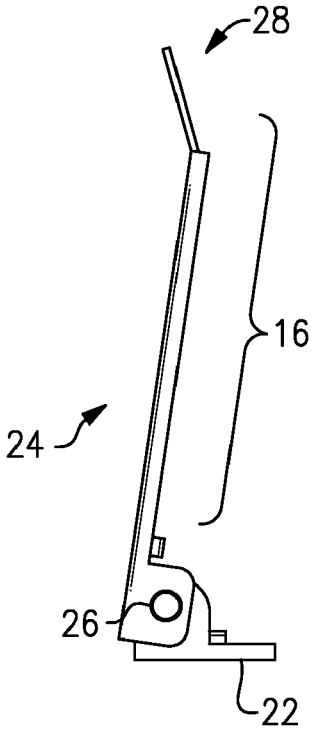
FIG. 14 is a side view of the foot pad or step pad.

Details of a preferred foot pad 16 employed on the hold-down are shown in FIGS. 11 through 15. There is a base 22 that attaches to the strap 14. A foot lever 24 is attached onto the base by means of a pivot pin 26. At the outer or free end of the foot lever 24 is a tab portion 28 that is angled outward somewhat, so as to form an open angle of about 155 degrees (FIG. 14). A spring 30 is positioned at the pivot pin and secured between the base 22 and the lever 26, so as to bias the lever upward. Normally, the foot pads 16 are pressed against the sides of the pail, and out of the way. However, these can swing down by foot action, simply by the worker stepping down onto them. The tabs 28 are angled in respect to the rest of the levers, and project out from the free ends of the levers 24 just enough to allow the worker to get a purchase on the lever 24 to push it down.

The device as shown allows the worker to secure the bucket 10 and its contents, simply by standing on the two foot pads or step pads. These hold the bucket steady so the contents of the bucket can be mixed without danger of the bucket tipping over and spilling.

In other possible embodiments, the foot pads can be secured directly onto the circular lower edge of the sidewall at the base of the pail, either by forming the bases 22 directly when the pail is manufactured, or by riveting or cementing the foot pads onto the base of the pail. The strap portion 14 is steel in the described embodiment, but may be made of a plastic material with suitable reinforcement. Also, the bases and levers of the foot-pads may be of steel, or may be molded of a suitable plastic material.

The hold-down can be moved from one bucket to another by releasing the latch and then attaching the strap onto the other bucket. Optionally, there can be a lock mechanism in the step-pads, either to lock them in the down, extended position, or to lock them in the raised, withdrawn position. There can be four step pads in some cases, positioned at about ninety degree intervals. Also, some possible embodiments can have fixed, non-folding step-pads.

While the invention has been described with reference to specific preferred embodiments, the invention is certainly not limited to those precise embodiments. Rather, many modifications and variations will become apparent to persons of skill in the art without departure from the scope and spirit of this invention, as defined in the appended claims.

We claim:

1. A bucket stabilizing hold-down device for securing a bucket while stirring or mixing contents thereof, the device comprising a pair of spring-loaded swing-down step-pad members, and means securing the two step-pad members onto diametrical opposite sides of the bucket at its lower end; said securing means including a band situated at a lower end of the bucket, and having a pair of base members disposed diametrically opposite one another on said band, and onto which the step pad members are respectively pivoted; the step pad members each including a foot lever, a pivot pin mounting the foot lever to the associated base member such that the foot levers are each movable between a raised position in which the foot lever is pressed against the side of the bucket above said band, and a lowered position in which the foot levers project generally horizontally from said band at the lower end of the bucket, and the foot pad members each further including a spring normally biasing the associated foot lever into its raised position against the side of the bucket, but yielding to allow the foot lever to be urged to its lowered position by foot pressure of a person stepping on the foot lever.

2. The device according to claim 1, wherein said band includes a strap adapted to encircle the lower end of the bucket.

3. The device according to claim 2, including a draw latch mounted on the strap to close ends thereof to one another.

4. The device according to claim 3, wherein said draw latch includes a screw adjustment to allow the device to accommodate variations in bucket diameters.

5. The device according to claim 1, wherein each said foot lever has a tab at its free end that is angled outward therefrom, such that the tab angles away from the bucket when the foot lever is in its raised position against the side of the bucket.

6. The device according to claim 1, wherein said band includes the lower end of said bucket, and rivets securing the bases for said step-pad members onto the lower end of said bucket.

7. The device according to claim 1 wherein said foot levers are each in the form of a flat oblong rigid member with one end thereof mounted by said pivot pin to said base, and having a tab portion at the other end and extending at an angle therefrom, so that the tab angles out away from the bucket when the foot lever is in the raised position thereof.

* * * * *